US008375932B2

(12) United States Patent
Comas

(10) Patent No.: US 8,375,932 B2
(45) Date of Patent: Feb. 19, 2013

(54) MANUAL CERAMICS CUTTER

(75) Inventor: Josep Torrents I Comas, Barcelona (ES)

(73) Assignee: Germans Boada, S.A., Rubi (Barcelona) (ES)

( * ) Notice: Subject to any disclaimer, the term of this patent is extended or adjusted under 35 U.S.C. 154(b) by 54 days.

(21) Appl. No.: 12/529,027

(22) PCT Filed: Oct. 3, 2007

(86) PCT No.: PCT/ES2007/000553

§ 371 (c)(1),
(2), (4) Date: Sep. 27, 2010

(87) PCT Pub. No.: WO2009/043944

PCT Pub. Date: Apr. 9, 2009

(65) Prior Publication Data

US 2011/0023859 A1 Feb. 3, 2011

(51) Int. Cl.
*B28D 1/24* (2006.01)

(52) U.S. Cl. ..... 125/23.02; 225/96.5

(58) Field of Classification Search ..... 125/13.02, 125/13.01, 23.01, 23.02; 225/96.5, 96
See application file for complete search history.

(56) References Cited

U.S. PATENT DOCUMENTS

| | | | | |
|---|---|---|---|---|
| 4,026,262 | A * | 5/1977 | Yasuga | 125/23.02 |
| 4,693,232 | A * | 9/1987 | Yasuga | 125/23.02 |
| 4,922,886 | A * | 5/1990 | Hepworth | 125/23.01 |
| 6,269,994 | B1 * | 8/2001 | Harrington | 225/96.5 |

FOREIGN PATENT DOCUMENTS

| | | |
|---|---|---|
| ES | 2017197 | 1/1991 |
| ES | 2029516 | 8/1992 |
| ES | 1062584 | 7/2006 |

* cited by examiner

*Primary Examiner* — Robert Rose
(74) *Attorney, Agent, or Firm* — Leason Ellis LLP

(57) ABSTRACT

The invention relates to a cutter including: a base (1) with an upper surface for supporting the ceramic part (9*a*, 9*b*, 9*c*) to be cut, a longitudinal rail (2) positioned above the longitudinal mid-zone of the base (1) parallel thereto, and a moveable handle (3) bearing the cutting disc (4) and having a longitudinal passage for guiding same. The handle (3) includes a cam (5) disposed vertically facing the lower end of the rail (2) and associated with a positioning knob (7) which determines the position of cam (5) sectors of different heights in relation to the lower end of the rail (2), in order to position the handle (3) at different heights but at a similar angle during the cutting of parts of different thicknesses.

5 Claims, 5 Drawing Sheets

MANUAL CERAMICS CUTTER

OBJECT OF THE INVENTION

The present invention refers to a manual ceramic cutter, being of the type that has a support base with an upper surface for the support of the ceramic parts to be cut, a longitudinal guide or rail arranged parallel and over the mid longitudinal area of the base and a handle that moves along the said longitudinal rail, said moveable handle bearing cutting tool or disc for the marking of the cutting line on the tile, and some lower feet to cause the pressing and breaking of the piece of tile along the cutting line marked by the disc.

BACKGROUND TO THE INVENTION

Utility model ES1062584U describes a manual tile cutter which has a base that forms the support surface for the tile to be cut, a longitudinal rail fixed at the ends on the base and arranged in parallel and over the mid longitudinal area of the base and a moveable handle being the carrier for a cutting disc for the marking of the cutting line on the tile of the piece of tile supported on the base.

Said handle is assembled on the rail with the possibility of longitudinal movement and with the possibility of folding down on a vertical plane, said handle having a longitudinal passage in its mid area so as to be guided along the cutter rail. The stated longitudinal passage is defined above and below by some roller bearings or elements fitted respectively on top and below the longitudinal cutting rail, in such a way as when the handle is folded downwards, the cutting disc fitted below on the rear end of the handle, is held against the piece of tile to be cut, and a lower roller element, fitted to the front end of the handle acts as a support point for the handle against the lower end of the rail. In said cutter, the marking of the tile is made by pressing the handle against the lower area and pushing it longitudinally along the rail. The breaking of the tile along the line marked by the cutter is carried out by means of some foldable feet between an operating position, appreciably vertical, and a non-operating position that is appreciably horizontal. Said foldable feet are assembled underneath onto the rear end of the handle, taking the longitudinal movement of the handle during the marking of the tile as reference.

Other known cutters and which have a greater relationship with that of this invention have an arrangement similar to that stated previously, but have some differences in so far as they refer to the orientation of the handle towards the front area, taking the advance direction as that of reference, the setting of the cutting disc that is located below at the rear end of the handle, as well as the feet for breaking the marked up part, which are fixed in relation to the handle, protruding vertically towards the lower part and arranged under the front section of the handle, also taking the advance direction of the handle as that of reference during the marking of the tile.

The arrangement of the disc and the feet means that in this second type of cutter, the handle must be raised towards the upper area until the disc makes contact with the tile and be moved longitudinally along the rail, generally driving it along to achieve the marking of the line along the tile so as to break the tile.

This type of cutter has the disadvantage that when parts with average or larger thickness have to be cut, the cutting disc makes contact with the tile surface when the handle is barely folded upwards, this means, when the handle is practically horizontal, this position meaning that the handle is uncomfortable for the operator to move the handle in a horizontal direction and to carry out its longitudinal advance along the rail during the marking of the tile.

DESCRIPTION OF THE INVENTION

The manual tile cutter object of the present invention, being of the above-mentioned type, has some particular constructional features aimed at avoiding the handle from being at a very reduced angle during the cutting of parts with average or greater thicknesses and to allow the arrangement of the handle at an angle that is enough so that the operator can drive it comfortably and to achieve the longitudinal movement during the marking of the tile, regardless of the thickness of the tile.

In order to do this and in accordance with the invention, the handle has a cam on the front lower end vertically facing the lower end of the rail and fitted on a transversal axis connected to a positioning knob, that in line with its angular position, determines the coming together of the sectors of the differing heights of the cam with lower end of the rail and consequently different heights of the handle to that of the rail.

This cam makes a point of support, with a variable height, for the handle against the rail, for the handle to be arranged in a more or less raised position for the cutting of the tiles which have greater or lesser thicknesses and to make the marking of the differing pieces of tile so that the handle has a similar angle, which is particularly comfortable for the operator.

The cam has an anti-friction surface or an external bearing for contact with the rail, making the longitudinal movement of the handle along the rail easier.

In accordance with the invention the handle and the positioning knob of the cam have some complementary coupling means for the stable holding of the knob, and consequently the cam, in the differing angular positions.

By preference these complementary means are made up of a retaining tooth formed on the handle and some complementary notches, distributed angularly on the cam positioning knob. In this way once the cam and the knob are positioned, their placement are held stable throughout the entire handling of the cutting until a new movement of the stated knob is made.

The cam and positioning knob are assembled without the possibility of being able to turn together on their axis, both fitted in a direct manner. In turn the positioning knob is assembled on the axis with the possibility of axial movement between two positions that enable the angular change of position of the knob and therefore of the cam in regard to the retaining tooth of the handle. This knob is connected to a pressure spring that applies pressure axially against said retaining tooth at it position of rest.

These and the other characteristics being claimed will be seen in greater detail in the description of a preferred embodiment.

DESCRIPTION OF THE FIGURES

In order to complement the description that has been made and for the purpose of making the characteristics of the invention easier to understand, attached to this present document is a set of drawings in which, by way of being illustrative but not by way of being a limitation, the following has been represented.

A PREFERRED EMBODIMENT OF THE INVENTION

As can be observed in the referenced FIGS, this manual tile cutter has a base (1) with an upper surface for the support of the tile (9*a*, 9*b*, 9*c*) to be cut, and a longitudinal rail (2) fitted in parallel and over the mid longitudinal area of the base (1), with a moveable handle (3) on this rail that carries the cutting disc (4), for the marking of the cutting area of the tile (9*a*, 9*b*, 9*c*) supported on a cutter base (1).

Figure 1:
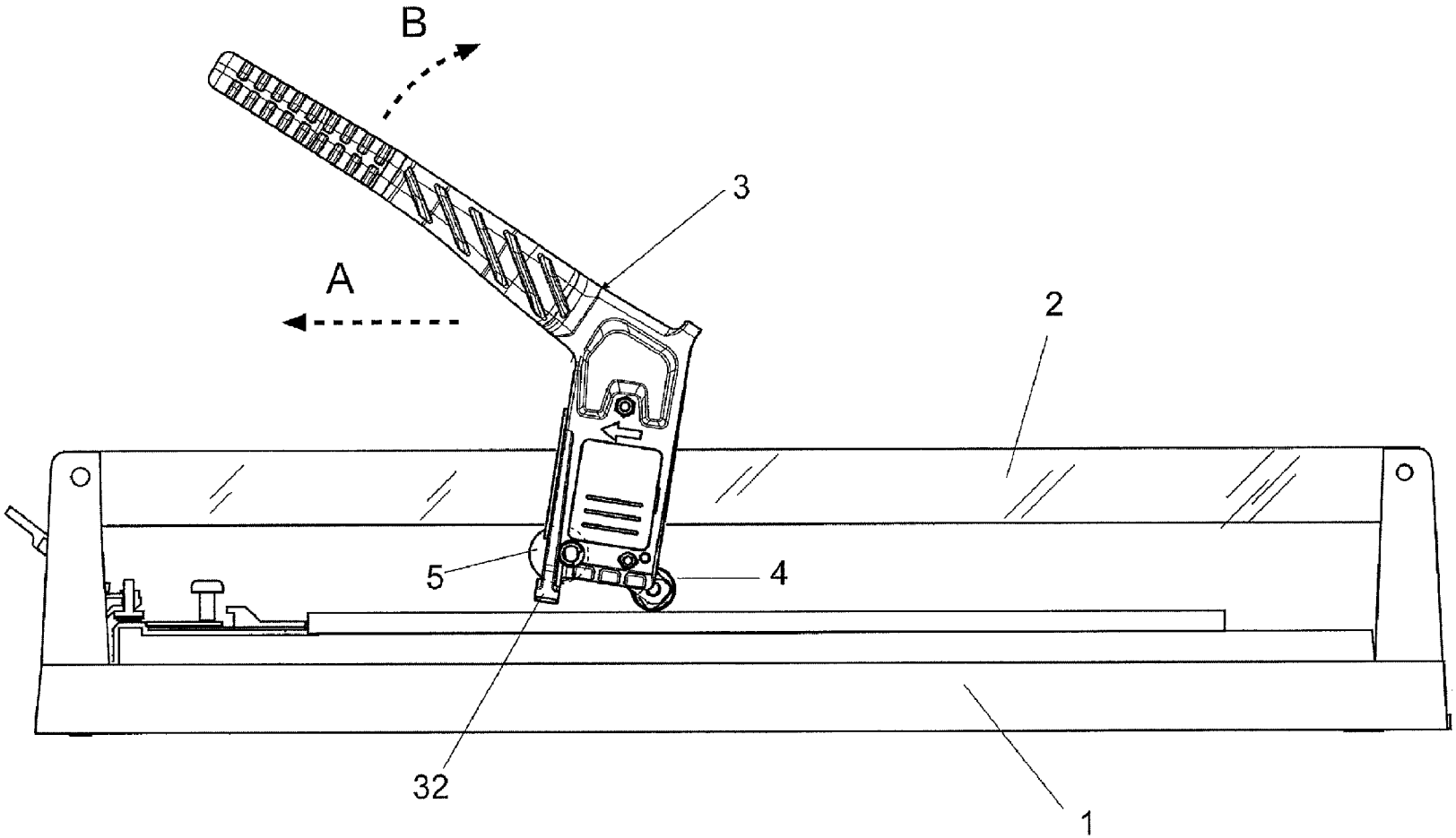
FIG. 1 shows a profile view of the cutter.
Figure 2:
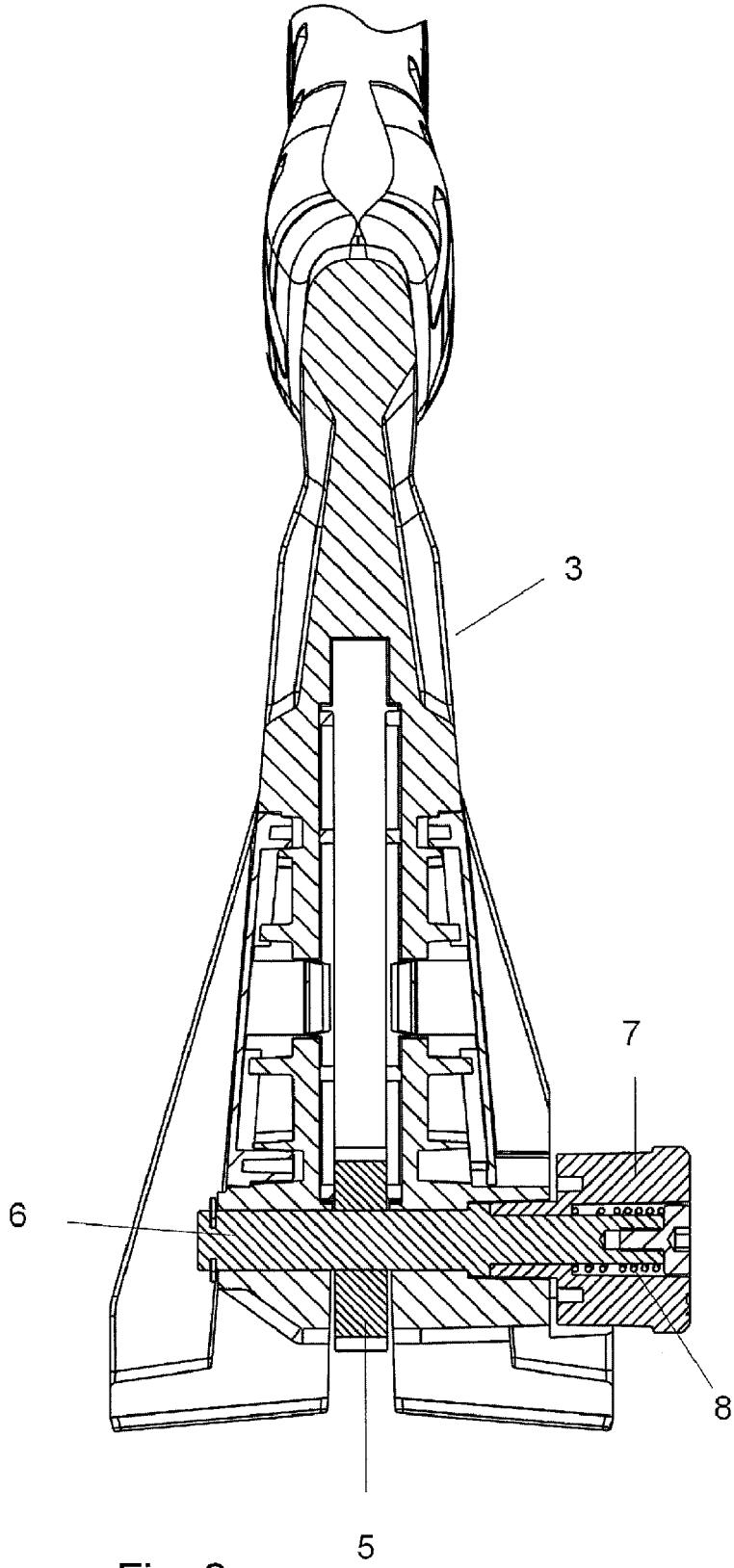
FIG. 2 shows a transverse section detail of the handle on the rail, where the support of the cam on the lower part of said rail can be seen.
Figure 3:
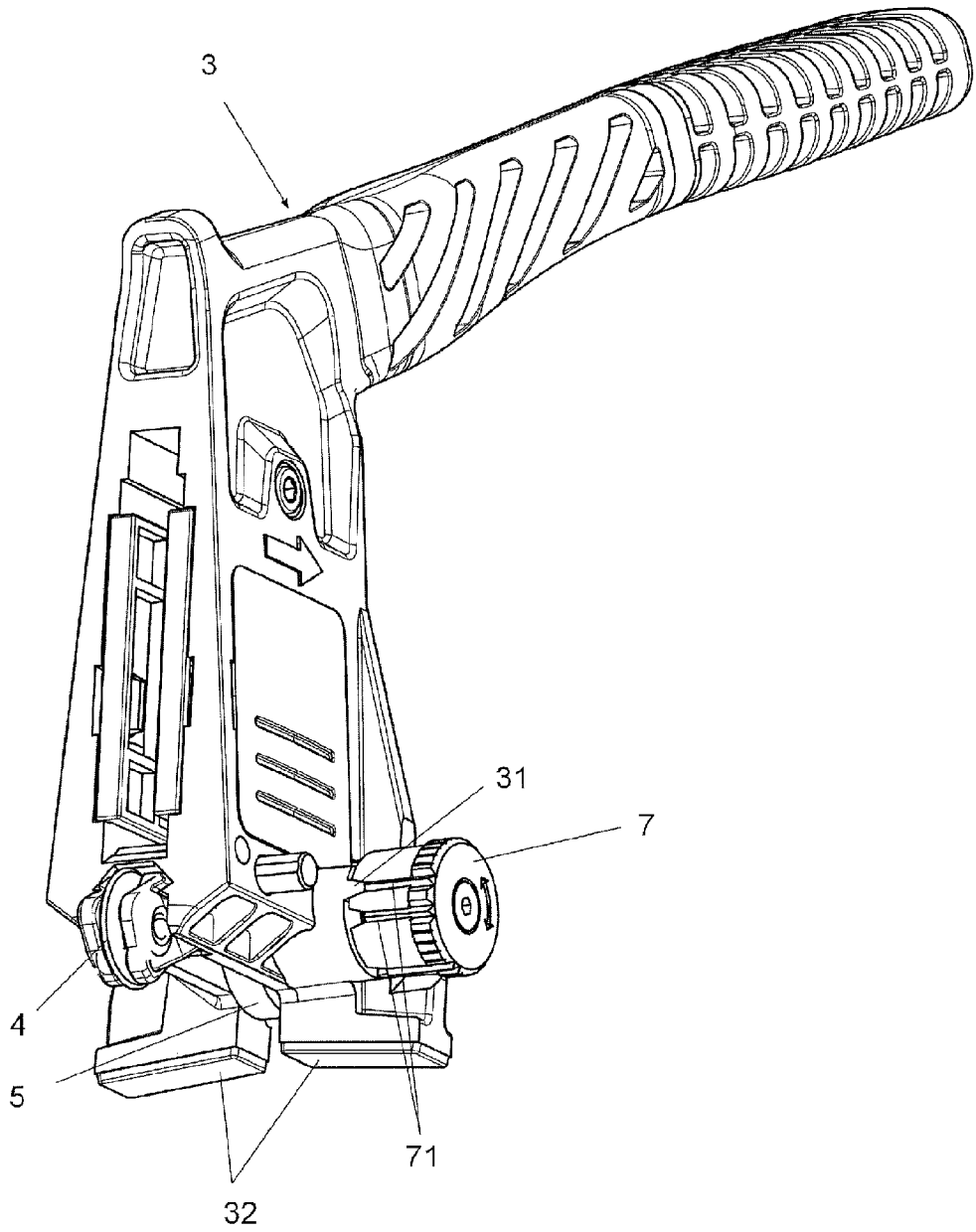
FIG. 3 shows a lower perspective view of the handle where the positioning knob can be seen.

The advance direction (A) and the folding direction (B) of the handle (3) during the marking process of a tile on the cutter base (1) have been shown in FIG. 1 by means of an arrow. The stated direction of advance (A) being taken as the point of reference, the gripping area of the handle (3) being oriented towards the front and the cutting disc (4) fitted in the rear area of the handle (3).

The handle (3) has a longitudinal passage so as to guide it along the rail (2), and a cam (5) vertically facing the lower end of the rail (2) arranged below in the front area of the handle (3) and fitted onto a transversal axis (6).

This axis (6) is connected to a positioning knob (7) by means of some complementary coupling devices, made up of a retaining tooth (31) defined in the handle (3) and some complementary notches (71) distributed angularly in said positioning knob (7) of the cam (5).

The positioning knob (7) and the cam (5) are arranged on an axis (6) without the possibility of joint turning, but the positioning knob (7) being moveable axially between two positions that enable the angular position to be changed in regard to the retaining tooth (31) of the handle (3).

Figure 4:
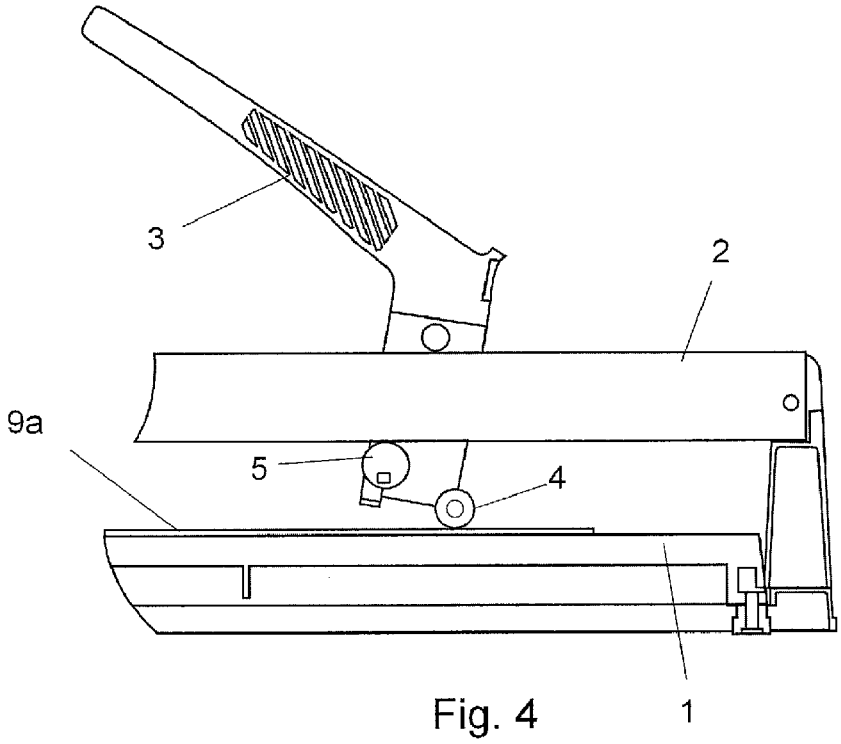
FIGS. 4, 5 and 6 respectively show diagrammatic views of the cutter with the cam in different angular positions and with the handle at different heights and with a similar inclination, during the cutting of pieces of tile that have differing thicknesses.
Figure 5:
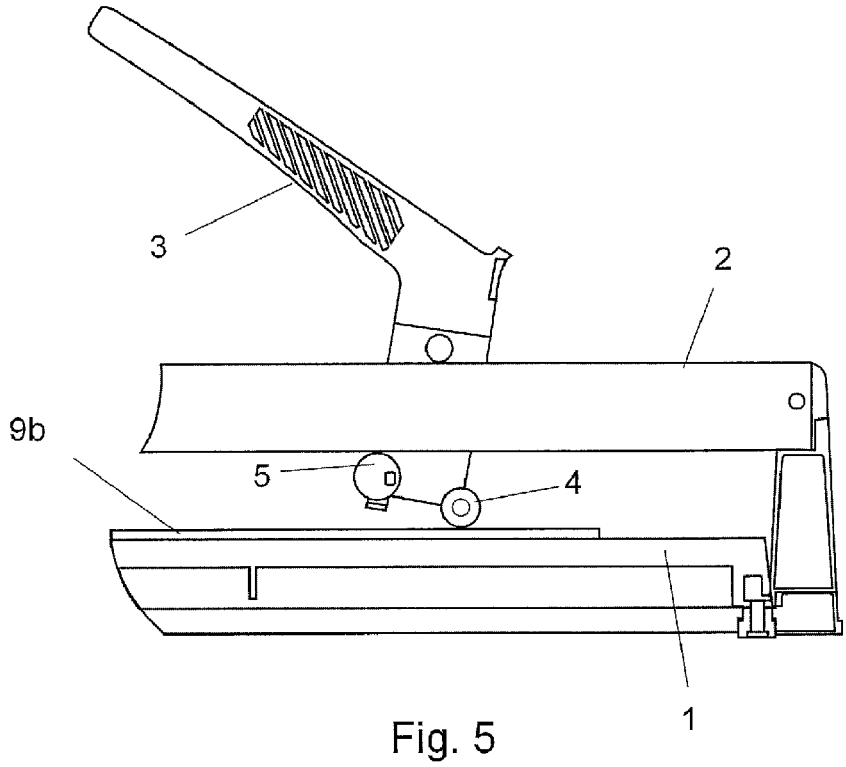
Figure 6:
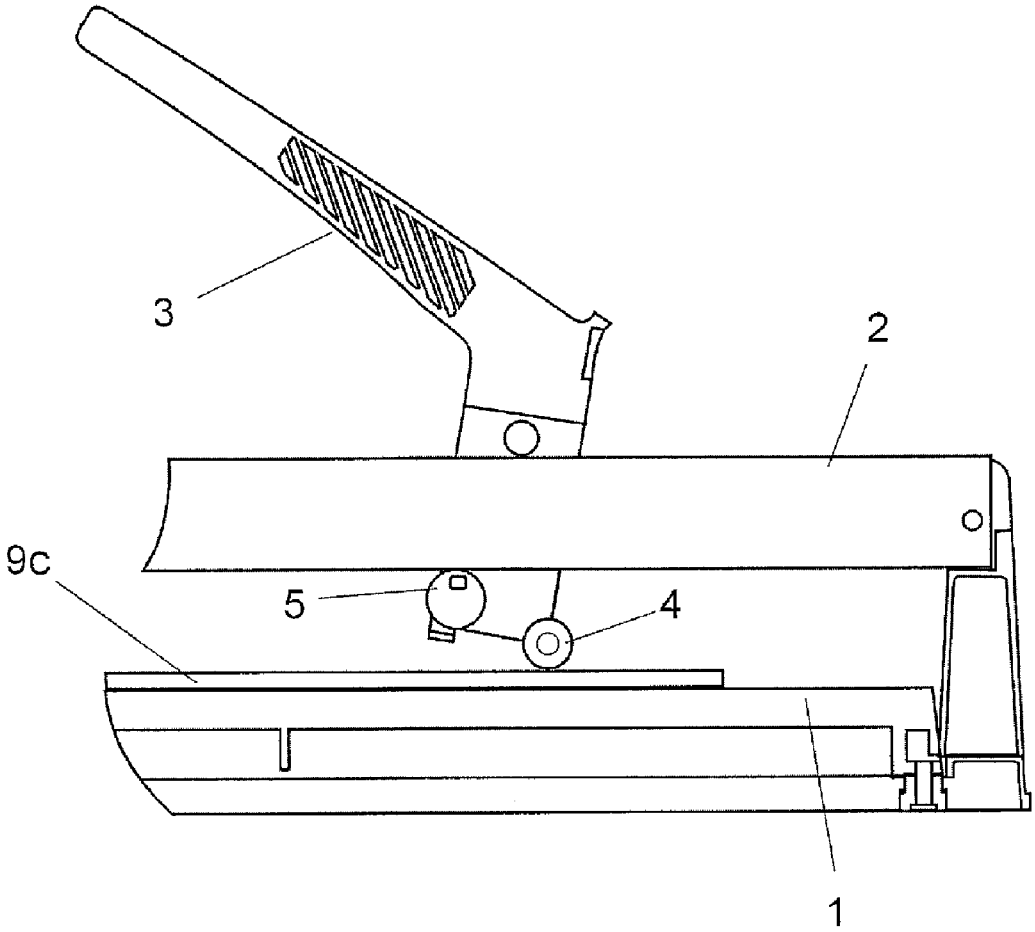

As and how described diagrammatically in FIGS. 4, 5 and 6, the arrangement of the cam (5) in different positions means that the handle is arranged at a similar angle during the marking of pieces of tile (9*a*, 9*b*, 9*c*) with differing thicknesses and which is sufficient so that the operator can drive the handle, in the advance direction (A) in a comfortable manner.

The positioning knob (7) is connected to a pressure spring (8) that applies axial pressure onto the tooth (31), guaranteeing the stable retention of the knob in any of the angular coupling positions with the knob.

As can be seen in the attached figures the handle (3) has some appreciably vertical feet (32) on the bottom at the front end so as to break the tile (9*a*, 9*b*, 9*c*) once the marking of the part has been made by the cutting disc (4).

Once having sufficiently described the nature of the invention as well as an example of its preferred embodiment, it is placed to be taken into account to all effects that the materials, shape, size and layout of the elements described can be modified, provided that they do not mean an alteration of the essential characteristics of the invention that is claimed below.

The invention claimed is:

1. A manual ceramics cutter, comprising a base with an upper surface for the support of the ceramic part to be cut, a longitudinal rail fitted parallel and above the longitudinal mid area of the base, and a moveable handle, carrying the disc cutter or disc tool for the marking of the area of the ceramic part to be cut, the ceramic part being supported on the base of the manual cutter, said handle having a longitudinal passage so as to guide it along the rail, wherein the handle has a cam vertically facing and contacting the lower end of the rail and assembled on a transversal axis, which is fitted to a positioning knob that according to its angular position determines the opposing arrangement of sections of differing heights of the cam with the lower end of the rail pressing against the lower end of the rail, such that said cam forms a variable height support point for the positioning of the handle against the rail and of the disc cutter or disc tool against the base, in a higher or lower position, keeping the same or a similar angle of inclination for the handle during the cutting of ceramic parts of greater or lesser thicknesses.

2. A cutter according to the claim 1, wherein the handle and positioning knob of the cam have complementary coupling devices for the stable retention of the cam at differing angular positions.

3. A cutter according to the claim 2, wherein the complementary coupling devices are made up of a retaining tooth positioned in the handle and some complementary notches distributed angularly in the positioning knob of the cam.

4. A cutter according to claim 1, wherein the cam and the positioning knob are assembled without the possibility of being able to turn on an axis.

5. A cutter according to the claim 4, wherein the positioning knob is assembled on an axis with the possibility of axial movement between two positions that enable the angular change of position of said positioning knob in regard to the retaining tooth of the handle and because it has a pressure spring that applies pressure from the positioning knob against the retaining tooth.

* * * * *